US011234464B2

(12) United States Patent
Qiu

(10) Patent No.: US 11,234,464 B2
(45) Date of Patent: Feb. 1, 2022

(54) ATOMIZING HEAD, ATOMIZER AND ELECTRONIC CIGARETTE THEREOF

(71) Applicant: CHANGZHOU JWEI INTELLIGENT TECHNOLOGY CO., LTD., Jiangsu (CN)

(72) Inventor: Weihua Qiu, Jiangsu (CN)

(73) Assignee: CHANGZHOU JWEI INTELLIGENT TECHNOLOGY CO., LTD., Jiangsu (CN)

( * ) Notice: Subject to any disclaimer, the term of this patent is extended or adjusted under 35 U.S.C. 154(b) by 317 days.

(21) Appl. No.: 16/246,359

(22) Filed: Jan. 11, 2019

(65) Prior Publication Data

US 2019/0142069 A1 May 16, 2019

Related U.S. Application Data

(63) Continuation of application No. PCT/CN2017/084479, filed on May 16, 2017.

(30) Foreign Application Priority Data

Jul. 13, 2016 (CN) ..... 201610551730.X

(51) Int. Cl.
*A24F 40/46* (2020.01)
*A24F 40/485* (2020.01)
(Continued)

(52) U.S. Cl.
CPC ..... *A24F 40/46* (2020.01); *A24F 40/485* (2020.01); *A24F 15/015* (2020.01); *A24F 40/10* (2020.01)

(58) Field of Classification Search
CPC ... A61M 15/06; A61M 15/015; A24F 47/008; A24F 40/46; A24F 40/485; A24F 40/10
See application file for complete search history.

(56) References Cited

U.S. PATENT DOCUMENTS 9,271,528 B2 * 3/2016 Liu ..... A61M 11/042
9,451,793 B2 * 9/2016 Zhou ..... A61M 15/06
(Continued)

FOREIGN PATENT DOCUMENTS

CN 203378558 U 1/2014
CN 203646511 U 6/2014
(Continued)

*Primary Examiner* — Marcus E Harcum
(74) *Attorney, Agent, or Firm* — Novick, Kim & Lee, PLLC; Allen Xue

(57) ABSTRACT

An atomizing head includes a heating assembly and an atomizing sleeve, the atomizing sleeve includes a first chamber and a second chamber in communication with each other, and the external airflow is successively flowing through the first chamber and the second chamber, and take away smoke formed by the aerosol forming substrate atomized by the heating assembly. The first chamber and the second chamber are spaced apart to effectively separate the airflow drawn from the outside with the second chamber. Since the airflow is completely passed through the entire atomizing head, it is difficult to form an effusion, the temperature of the heating element is substantially uniform everywhere, the airflow of the present disclosure is smooth, the heat conduction effect is good. In addition, the present disclosure uses a double heating assemblies, the amount of smoke is large and it is difficult to form an effusion.

18 Claims, 10 Drawing Sheets

(51) Int. Cl.
*A24F 15/015* (2020.01)
*A24F 40/10* (2020.01)

(56) References Cited

U.S. PATENT DOCUMENTS

| | | | | |
|---|---|---|---|---|
| 10,292,433 | B2 * | 5/2019 | Qiu | H03K 17/96 |
| 10,492,537 | B2 * | 12/2019 | Qiu | A24F 47/008 |
| 10,779,575 | B2 * | 9/2020 | Qiu | A24F 40/48 |
| 10,842,189 | B1 * | 11/2020 | Hermiz | A24F 40/42 |
| 10,856,581 | B2 * | 12/2020 | Qiu | A24F 47/008 |
| 2012/0260927 | A1 * | 10/2012 | Liu | A24F 47/008 131/329 |
| 2014/0060527 | A1 * | 3/2014 | Liu | A24F 47/008 128/202.21 |
| 2014/0190503 | A1 * | 7/2014 | Li | A61M 15/06 131/329 |
| 2014/0366898 | A1 * | 12/2014 | Monsees | A24F 47/008 131/329 |
| 2015/0059787 | A1 * | 3/2015 | Qiu | A24F 47/008 131/329 |
| 2016/0000146 | A1 * | 1/2016 | Zhu | H05B 3/44 392/404 |
| 2016/0007654 | A1 * | 1/2016 | Zhu | A24F 47/008 131/328 |
| 2016/0143358 | A1 * | 5/2016 | Zhu | A24F 47/008 131/329 |
| 2016/0157522 | A1 * | 6/2016 | Zhu | A24F 47/008 131/329 |
| 2017/0311648 | A1 * | 11/2017 | Gill | A24F 40/42 |
| 2017/0347705 | A1 * | 12/2017 | Li | A61M 15/0023 |
| 2018/0027874 | A1 * | 2/2018 | Zhu | H05B 3/03 |
| 2018/0035718 | A1 * | 2/2018 | Liu | A24F 47/00 |
| 2018/0049470 | A1 * | 2/2018 | Chen | A24F 47/008 |
| 2018/0213845 | A1 * | 8/2018 | Qiu | H05B 3/03 |
| 2018/0325176 | A1 * | 11/2018 | Burseg | A24F 47/008 |
| 2018/0332896 | A1 * | 11/2018 | Wang | H05B 1/0227 |
| 2019/0053544 | A1 * | 2/2019 | Yamada | A24F 47/00 |
| 2019/0297953 | A1 * | 10/2019 | Qiu | A24F 40/42 |
| 2020/0146348 | A1 * | 5/2020 | Hon | A24F 40/40 |
| 2020/0205478 | A1 * | 7/2020 | Dick | A24F 40/42 |

FOREIGN PATENT DOCUMENTS

| | | | | |
|---|---|---|---|---|
| CN | 203969206 | U | 12/2014 | |
| CN | 104287098 | A | 1/2015 | |
| CN | 204217908 | U | 3/2015 | |
| CN | 204217915 | U | 3/2015 | |
| CN | 204393353 | U | 6/2015 | |
| CN | 104872822 | A | 9/2015 | |
| CN | 105105339 | A | 12/2015 | |
| CN | 204907937 | U | 12/2015 | |
| CN | 105559146 | A | 5/2016 | |
| CN | 205284992 | U | 6/2016 | |
| CN | 106037011 | A | 10/2016 | |
| CN | 206043430 | U | 3/2017 | |
| EP | 3248480 | A1 * | 11/2017 | H05B 1/0227 |
| WO | 2013034454 | A1 | 3/2013 | |
| WO | 2014001432 | A1 | 1/2014 | |

* cited by examiner

ATOMIZING HEAD, ATOMIZER AND ELECTRONIC CIGARETTE THEREOF

CROSS-REFERENCE TO RELATED APPLICATIONS

This application is a continuation of International Patent Application No. PCT/CN2017/084479, filed on May 16, 2017, entitled "atomizing head, atomizer and electronic cigarette", which claims priority to Chinese Patent Application No. 201610551730.X, filed on Jul. 13, 2016, entitled "atomizing head, atomizer and electronic cigarette thereof". All of the aforementioned patent applications are hereby incorporated by reference in their entireties.

FIELD

The present disclosure relates to an electronic cigarette technical field, and particularly relates to an atomizing head an atomizer and an electronic cigarette using the same.

BACKGROUND

Electronic cigarettes, also known as virtual cigarettes, have an appearance similar to cigarettes, and have a similar taste to cigarettes, mainly used to simulate smoking sensation for smoking cessation or alternative cigarette use. The existing electronic cigarette generally includes an atomizer and a battery assembly. When the user smokes from the cigarette end, the flow of air causes the pneumatic switch in the atomizer to close, the battery assembly supplies power to the atomizer, and the atomizer atomizes. The heat generated by the head atomizes the liquid, so that the user has the effect of smoking.

At present, the atomizing head existing on the market generally does not directly enter the heating member, and the snorkel only reaches the uppermost part of the heat generating component, and the benefit of this will make the whole airflow smoother, but because the airflow is only from the heat The upper surface of the component passes over rather than completely passes through the entire heat-generating component, so that the bottom of the heat-generating component is liable to form effusion. In addition, due to the upward path of the airflow due to the upper and lower parts of the heat-generating component, the liquid-conducting component is always in different temperature environments during operation, which shortens the service life of the liquid guiding member. Moreover, the frequency at which the user replaces the heating member is increased.

SUMMARY

The object of the present disclosure is to provide an atomizing head capable of effectively reducing the effusion.

The disclosure is also to provide an atomizer with the atomizing head and an electronic cigarette having the atomizer.

An atomizing head includes a heating assembly and an atomizing sleeve, the atomizing sleeve includes a first chamber and a second chamber in communication with each other, and the external airflow is successively flowing through the first chamber and the second chamber, and take away smoke formed by the aerosol forming substrate atomized by the heating assembly.

In one embodiment, the first chamber and the second chamber are mounted within the atomizing sleeve and parallel to the axial direction of the atomizing sleeve.

In one embodiment, the bottom of the first chamber and the bottom of the second chamber are in communication with each other; or/and the first chamber and the second chamber are in communication with each through an air passage defined on the sidewall located therebetween and the air passage is disposed below the middle portion of the sidewall.

In one embodiment, the heating assemblies are at least two groups located in the first chamber and the second chamber respectively, the heating assembly includes a heating element and a liquid guiding member, the heating element is a hollow structure open at both ends, the heating element is surrounded by the liquid guiding member, the external airflow sequentially passes through the heating assembly in the first chamber, the heating assembly in the second cavity, and take away smoke formed by the aerosol forming substrate atomized by the heating assembly.

In one embodiment, the atomizing sleeve is a hollow structure opens at both ends, the atomizing sleeve includes an atomizing sleeve tube, a fixing groove, and a separator, the inner chamber of the atomizing sleeve tube is partitioned into a first chamber and a second chamber by the separator, the separator is located in a fixing groove of the inner wall of the atomizing sleeve tube.

In one embodiment, the side wall of the atomizing sleeve defines a first liquid inlet, a second liquid inlet is defined on the side wall of the atomizing sleeve opposite to the first liquid inlet, the first inlet is defined on the wall of the atomizing sleeve tube adjacent to the first chamber, the second inlet is defined on the wall of the atomizing sleeve tube adjacent to the second chamber, the cigarette liquid enter the inner cavity of the atomizing sleeve from the first liquid inlet and the second liquid inlet.

In one embodiment, the cross-sectional area of the first liquid inlet is smaller than the cross-sectional area of the second liquid inlet.

In one embodiment, the atomizing base includes a tubular body, the tubular body is upwardly convex and forms a barrel along the axial direction, and the atomizing sleeve is sleeved on the barrel and forms an air cavity with the bottom end of the atomizing sleeve.

In one embodiment, the atomizing head further comprising an atomizing head electrode contact and atomizing head insulating ring, the atomizing head insulating ring is sleeved on the atomizing head electrode contact, the atomizing head electrode contact is received in the atomizing base.

An atomizer includes any one of the above atomizing head.

In one embodiment, the atomizer further includes an adjusting assembly, the adjusting assembly includes an adjustment inner ring, and an adjustment outer ring, the adjustment inner ring is located at the top end of the liquid storage assembly, the adjustment outer ring is rotatably sleeved on the adjustment inner ring; one side of the peripheral wall of the adjustment inner ring is provided with an air intake, the other side of the peripheral wall of the adjustment inner ring is provided with an adjustment hole, the amount of the intake air is adjusted by adjusting the communication area of the adjustment hole and the air intake.

In one embodiment, the atomizer further includes an adjusting assembly, the adjusting assembly includes an adjustment inner ring, and an adjustment outer ring, the adjustment inner ring is located at the top end of the liquid storage assembly, the adjustment outer ring is rotatably sleeved on the adjustment inner ring; one side of the peripheral wall of the adjustment inner ring is provided with an injection hole, the other side of the peripheral wall is provided with an adjustment hole, when the adjustment hole is in communication with the injection hole, the aerosol forming substrate can be injected into the liquid storage assembly.

In one embodiment, the adjusting assembly includes a connecting member and a vent pipe, the connecting member is received in the liquid storage assembly, the vent pipe is sleeved in the connecting member, an air guiding space is formed between the outer peripheral wall of the vent pipe and the inner peripheral wall of the connecting member, the air guiding space is in communication with the first chamber.

An electronic cigarette includes any one of the above atomizer.

The beneficial effects of the device are:

The atomizing sleeve of the atomizing head of the present disclosure includes a first chamber and a second chamber, which are in communication with each other. The first chamber and the second chamber are respectively provided with a heating assembly; the external airflow sequentially passes through the first chamber and the second chamber, and carries away the aerosol formed by the aerosol forming substrate heated by the heating assembly. Since the airflow is completely passed through the entire atomizing head, it is difficult to form an effusion, the temperature of the heating element is substantially uniform everywhere, the airflow of the present disclosure is smooth, the heat conduction effect is good. In addition, the present disclosure uses a double heating assemblies, the amount of smoke is large and it is difficult to form an effusion.

Figure 1:
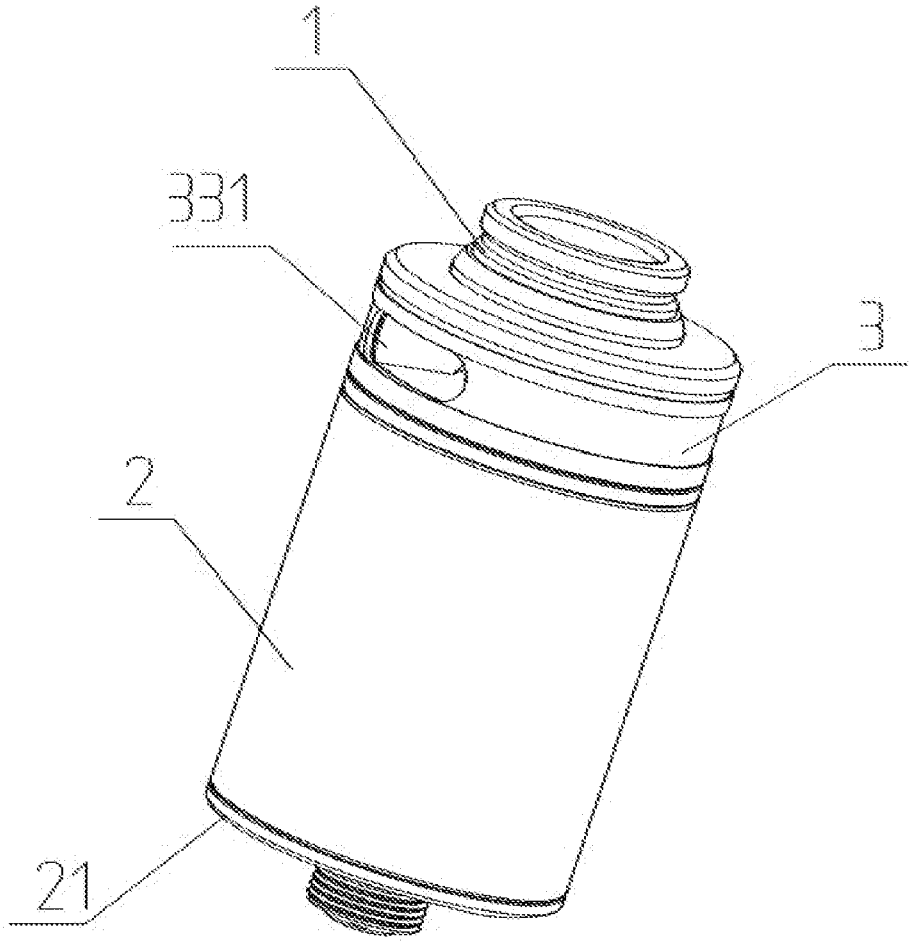
FIG. 1 is a perspective view of an atomizer according to an embodiment of the present disclosure when the adjustment hole is in communication with the intake port.

The following table list various components and reference numerals thereof.

| | |
|---|---|
| Top connector 1 | First positive contact 231 |
| Liquid storage assembly 2 | First insulating ring 232 |
| Adjusting assembly 3 | Second positive contact 233 |
| Atomizing head 4 | Second insulating ring 234 |
| Lower cover 21 | Heating assembly 41 |
| Liquid storage tube 22 | Atomizing sleeve 42 |
| Electrode contact assembly 23 | Atomizing head insulating ring 45 |
| Cover bottom plate 211 | Atomizing base 46 |
| Convex ring 212 | Atomizing head electrode contact 44 |
| Pipe portion 213 | Heating assembly 411 |

-continued

| | |
|---|---|
| Sealing gasket 214 | Liquid guiding element 412 |
| First chamber 48 | First heating assembly 413 |
| Second chamber 49 | Second heating assembly 414 |
| Reservoir chamber 36 | Air cavity 47 |
| Fixing groove 422 | Connecting member 31 |
| Separator 423 | vent pipe 32 |
| Protrusion body 4213 | Adjustment inner ring 33 |
| Tubular body 461 | Adjustment outer ring 34 |
| barrel 462 | Air guiding space 37 |
| Groove 463 | Air intake 331 |
| Boss 4233 | Injection hole 332 |
| Protrusion portion 4234 | Mating hole 333 |
| First liquid inlet 4211 | Liquid guiding hole 334 |
| Second liquid inlet 4221 | Center hole 341 |
| Third liquid inlet 4222 | Adjustment hole 342 |
| Partition member 4231 | Guiding tube 11 |
| Fixing member 4232 | Smoke guiding hole 12 |
| Atomizing sleeve tube 421 | |

DETAILED DESCRIPTION OF PREFERRED EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

When a feature or element is herein referred to as being "on" another feature or element, it can be directly on the other feature or element or intervening features and/or elements may also be present.

Terminology used herein is for the purpose of describing particular embodiments only and is not intended to be limiting of the disclosure. As used herein, the term "and/or" includes any and all combinations of one or more of the associated listed items and may be abbreviated as "/".

Figure 3:
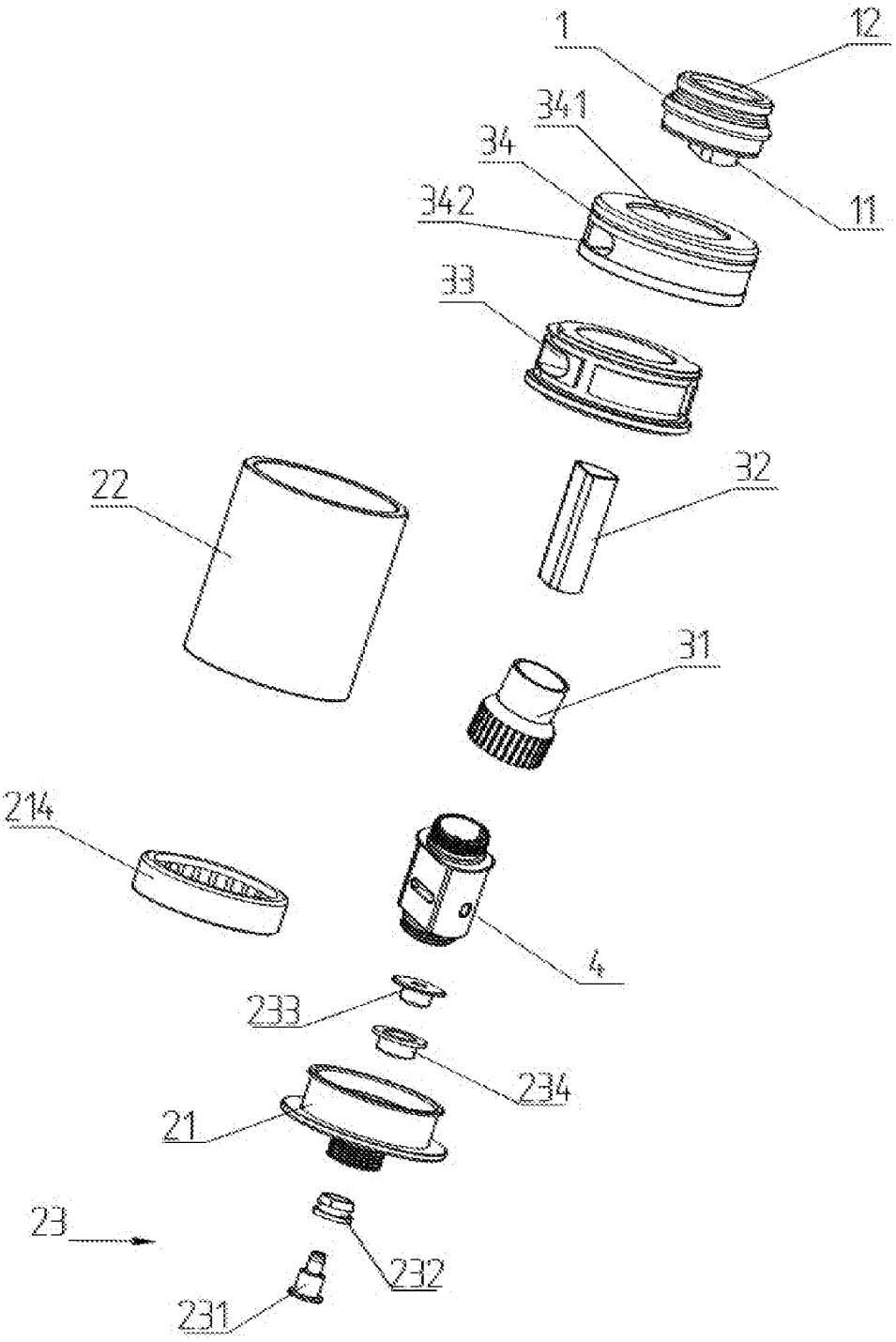
FIG. 3 is an exploded view of the atomizer of FIG. 1.
Figure 4:
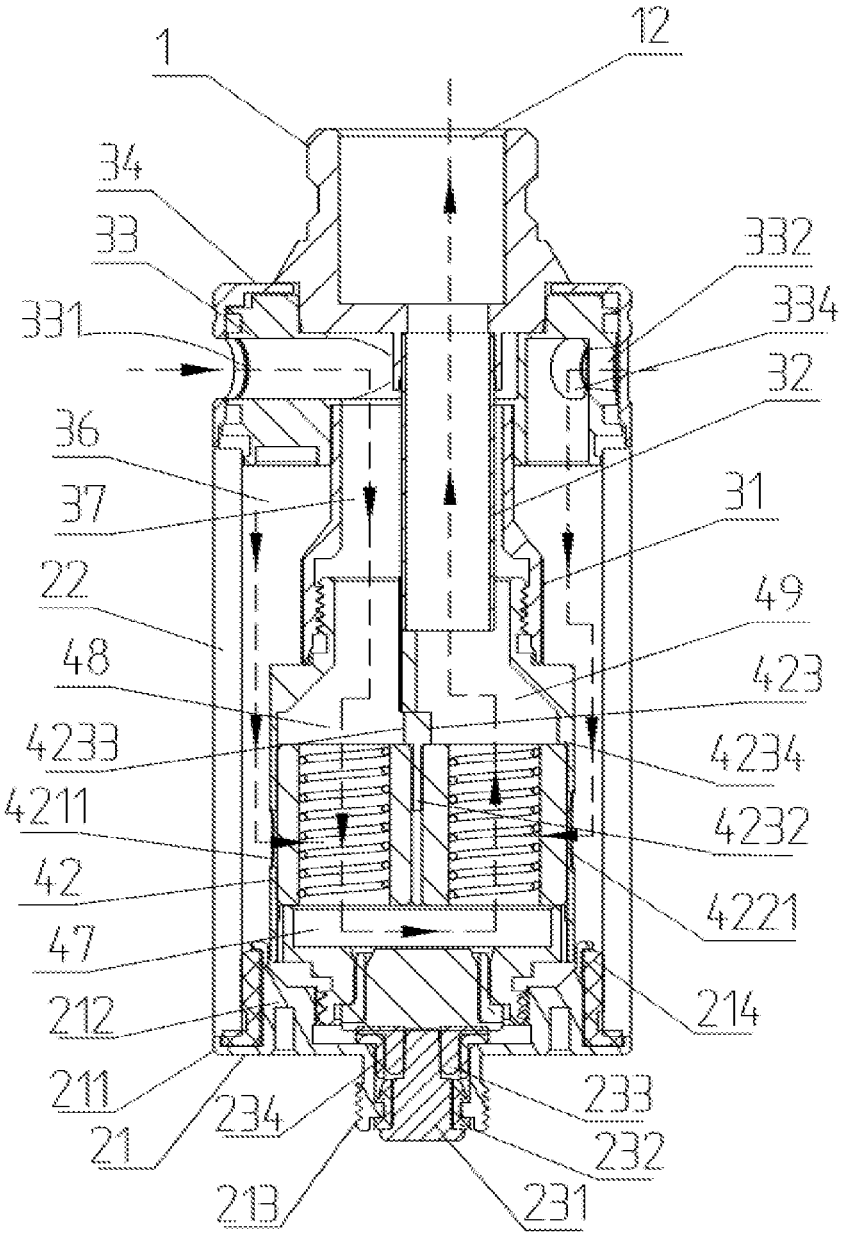
FIG. 4 is a cross-sectional view of the atomizer of FIG. 1.

Referring to FIG. 3 and FIG. 4, an embodiment of the present disclosure provides an atomizer for an electronic cigarette, the atomizer includes a top connector 1, a liquid storage assembly 2, an adjusting assembly 3, and an atomizing head 4. The atomizing head 4 is mounted in the liquid storage assembly 2, the adjusting assembly 3 is mounted on the upper end of the liquid storage assembly 2 engaging with the top connector 1.

Referring to FIG. 3 and FIG. 4 together, the liquid storage assembly 2 includes a lower cover 21, a liquid storage tube 22, and an electrode contact assembly 23. The atomizing head 4 is located in the liquid storage tube 22, the lower cover 21 includes a cover bottom plate 211. A convex ring 212 is protruded from the upper surface of the cover bottom plate 211 adjacent to the outer circumference. A stepped notch is formed between the outer circumferential side of the convex ring 212 and the upper surface of the cover bottom plate 211 correspondingly to the convex ring 212. A pipe portion 213 is protruded from the center of the lower surface of the cover bottom plate 211, an external thread is formed on the outer peripheral wall of the pipe portion 213. The liquid storage tube 22 is mounted on the upper end of the lower cover 21, the bottom end of which is sleeved on the outer circumference of the convex ring 212. A sealing gasket 214 is provided between the liquid storage tube 22 and the convex ring 212 to enhance the sealing property therebetween. In the embodiment, the sealing gasket 214 is a silicone sealing gasket 214. The liquid storage tube 22 is a transparent pipe made of glass material or the like so as to facilitate the user view the amount of the liquid stored in the liquid storage tube 22. The liquid storage tube 22 can also be made of other translucent or transparent materials, as long as it is convenient for the user to observe the remaining amount of the liquid stored in the liquid storage tube 22. The electrode contact assembly 23 is located in the pipe portion 213 on the cover bottom plate 211 to electrically connected to the atomizing head 4. The electrode contact assembly 23 includes a positive electrode contact assembly and a negative electrode contact assembly. The positive electrode contact assembly includes a first positive contact 231, a first insulating ring 232, a second positive electrode contact member 233, and a second insulating ring 234. The first positive contact 231 is mounted in the pipe portion 213 and is insulated from the tube wall of the pipe portion 213 by the first insulating ring 232. The second positive electrode contact 233 is sleeved at the top end of the first positive contact 231 and is insulated from the tube wall of the pipe portion 213 through the second insulating ring 234. The second positive electrode contact 233 is electrically connected to the atomizing head electrode contact 44. The first insulating ring 232 and the second insulating ring 234 can be a silicone pad respectively to enhance the sealing function to prevent the smoke liquid from leakage. The negative electrode contact assembly can be composed of the pipe portion 213 of the lower cover 21 and an outer wall of the atomizing head 4. The tube wall of the pipe portion 213 is made of metal materials and is electrically conductive. The negative electrode contact assembly is coupled to the negative electrode of the battery assembly (not shown) through the external thread of the pipe portion 213.

Figure 8:
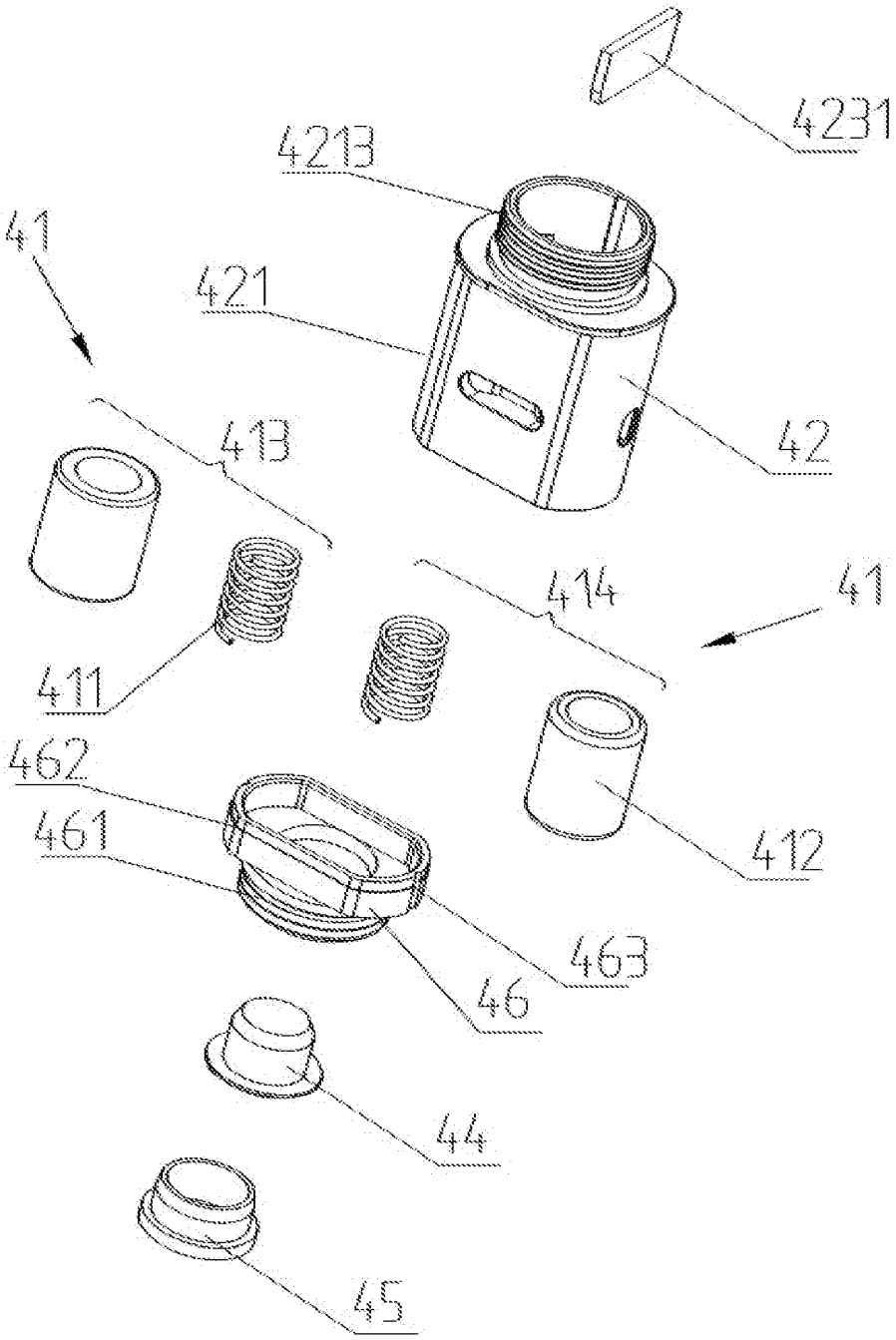
FIG. 8 is an exploded view of the atomizing head of the present disclosure.
Figure 9:
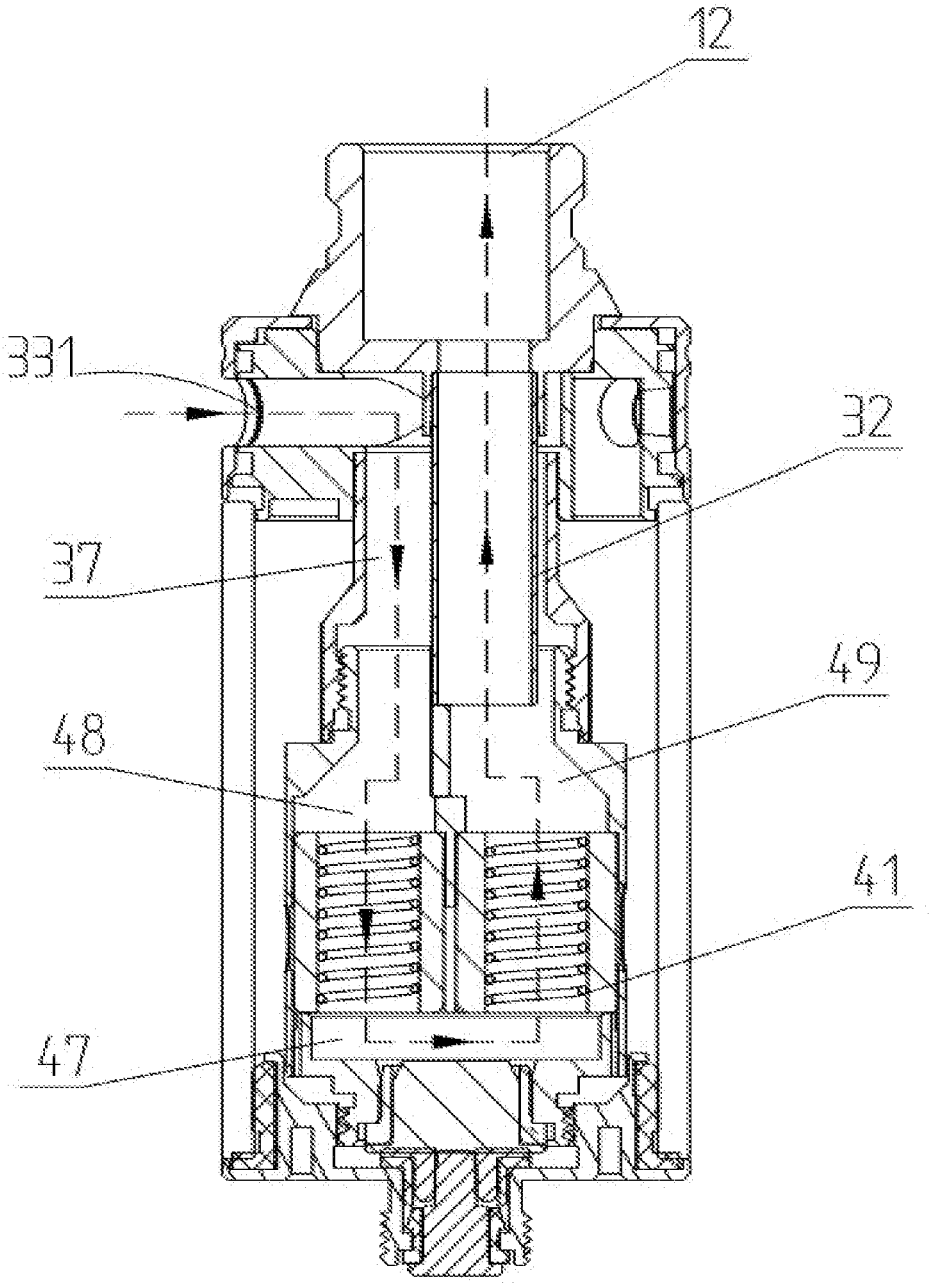
FIG. 9 is a schematic view of the airflow of the atomizer of the embodiment of the present disclosure.
Figure 10:
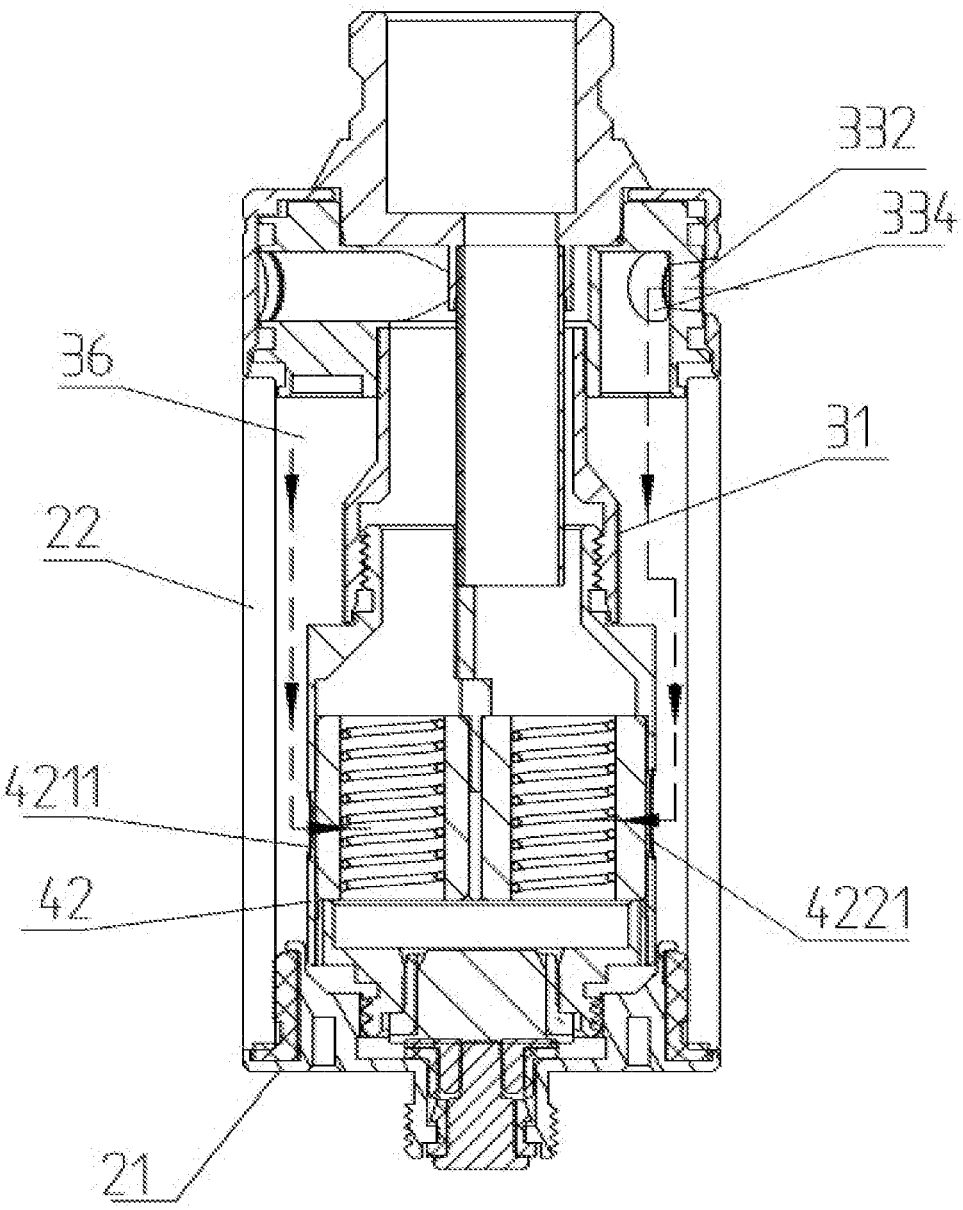
FIG. 10 is a schematic view of the liquid intake mode of the atomizer according of the embodiment of the present disclosure.

Referring to FIG. 8, according to one of the embodiments of the present disclosure, the atomizing head 4 includes a heating assembly 41, an atomizing sleeve 42, an atomizing head electrode contact 44, and an atomizing base 46. The atomizing sleeve 42 is mounted on the top of the atomizing base 46, the outer peripheral surface of the bottom end of the atomizing sleeve 42 is provided with an external thread. The atomizing sleeve 42 includes a first chamber 48 and a second chamber 49 in communication with each other. The first chamber 48 and the second chamber 49 are provided with a heating assembly 41 therein, respectively. The external airflow is sequential flowing through the first chamber 48, the second chamber 49, and take away the smoke formed by the aerosol forming substrate atomized by the heating assembly 41. The aerosol forming substrate can be cigarette liquid. The first chamber 48 and the second chamber 49 are disposed in the atomizing sleeve 42 and parallel to the axial direction of the atomizing sleeve 42. The first chamber 48 is in communication with the second chamber 49, the external airflow sequentially passes through the first chamber 48 and the second chamber 49, and carries away the aerosol formed by an aerosol forming substrate that is atomized by the heating component. Specifically, the bottom of the first chamber 48 is in communication with the bottom of the second chamber 49; or the first chamber 48 and the second chamber 49 are located side-by-side, the atomizing head 4 is provided with an air passage in communication between the first chamber 48 and the second chamber 49. In one embodiment, the air passage is disposed below the middle portion of the sidewall located between the first chamber 48 and the second chamber 49.

The heating assembly 41 includes a first heating assembly 413 located in the first chamber 48 and a second heating assembly 414 located in the second chamber 49. The heating assembly 41 is mounted within the atomizing sleeve 42. There are two groups of heating assemblies 41, the heating assemblies 41 parallel to the axial direction of the atomizing sleeve 42. The top end of the atomizing base 46 and the bottom end of the atomizing sleeve 42 forms an air cavity 47. The external airflow passes through the first chamber 48, to the air cavity 47 and out through the second chamber 49, thereby forming a U-shaped airflow path. The heating assembly 41 is at least two groups as long as the airflow path can be formed. In this embodiment, the external airflow enters through the first chamber 48, to the air cavity 47 and flows out through the second chamber 49, such that the airflow can pass through the inner chamber of the heating assembly 41 to form an airflow path, whereby the airflow inhaled from the outside can effectively space apart from the aerosol formed in the second chamber 49 to take away the aerosol-forming substrate atomized by the heat generating component. Since the airflow completely passes through the entire heating assembly 41, it is difficult to form effusion, which also can make the temperature of the heating assembly 41 substantially uniform. Since the heating assembly 41 is respectively disposed on the first chamber 48 and the second chamber 49, the airflow of is smooth and the heat conduction effect is good. Further, the use of dual heating components greatly increases the amount of smoke.

The heating assembly 41 includes a heating element 411 and a liquid guiding member 412. The heating element 411 is a hollow structure open at both ends. The liquid guiding member 412 surrounds the heating element 411. The external airflow enters through the first chamber 48, to the inner cavity of the heating member 411, to the air cavity 47 and flowing out through the second chamber 49. The liquid guiding member 412 is configured to absorb the cigarette liquid, the liquid guiding member 412 can be made of the material with good liquid absorption effect, such as cotton or cotton cloth, fiber cotton or porous ceramic material.

Referring to FIG. 8, according to an embodiment of the present disclosure, the atomizing base 46 includes a tubular body 461, t the tubular body 461 is threaded. The tubular body 461 is upwardly convex and forms a barrel 462 along the axial direction. The tubular body 461 has a substantially cylindrical structure and engages with the bottom end of the atomizing sleeve 42 and the atomizing sleeve 42 can be sleeved on the barrel 462. The atomizing sleeve 42 is mounted on the top of the atomizing base 46. The circumferential side of the atomizing base 46 is provided with a groove 463 along its axial direction, the pin of the heating element 411 is fixed in the groove 463 (not shown) to reach the electrode connection. The atomizing head insulating ring 45 is sleeved on the atomizing head electrode contact 44, the atomizing head electrode contact 44 is received in the atomizing base 46. The atomizing head insulating ring 45 is insulated from the tube wall of the atomizing base 46. In this embodiment, the atomizing head electrode contact 44 is a positive electrode contact member and is connected to the heating member 411. It can be understood that, the negative electrode is electrically connected to the heating member 411. The atomizing head 4 is connected to the cover bottom plate 211 by the screw at the lower end of the atomizing sleeve 42, the atomizing sleeve 42 is electrically connected to the cover bottom plate 211.

In one embodiment, the atomizing sleeve 42 is a hollow structure opens at both ends. The atomizing sleeve 42 includes an atomizing sleeve tube 421, a fixing groove 422, and a separator 423. A protrusion body 4213 is threaded and is protruded from a top end of the atomizing sleeve tube 421. The inner chamber of the atomizing sleeve tube 421 is partitioned into a first chamber 48 and a second chamber 49 by the separator 423. The first chamber 48 and the second chamber 49 are in communication with each other through their adjacent sidewalls.

In one embodiment, the separator 423 is mounted in a fixing groove 422 of the inner wall of the atomizing sleeve tube 421. The separator 423 is spaced apart from the top end of the atomizing sleeve 42 by a certain distance. A boss 4233 placed upside down is formed in a middle portion of the separator 423. A protrusion 4234 is axially disposed on the inner wall of the atomizing sleeve tube 421. Especially, the protrusion 4234 is disposed on where the inner wall of the atomizing sleeve tube 421 is parallel to the top of the boss 4233. The boss 4233 and the protrusion 4234 are configured to fix the heating assembly 41 that enters from the bottom of the atomizing sleeve tube 421 and is installed in the atomizing sleeve tube 421. The heating assembly 41 forms an air cavity 47 with the atomizing sleeve tube 421.

In one embodiment, the separator 423 includes a partition member 4231 and a fixing member 4232, the partition member 4231 is mounted in the fixing groove 422 of the inner wall of the atomizing sleeve tube 421, the partition member 4231 is reserved with a certain distance from the top end of the atomizing sleeve 42. The bottom end of the partition member 4231 is connected with the top of the fixing member 4232, the fixing member 4232 is integrally formed with the atomizing sleeve tube 421. In one embodiment, the fixing member 4232 is a fixing piece.

In one embodiment, the wall of the atomizing sleeve tube 421 adjacent to the first chamber 48 is provided with a first liquid inlet 4211, the wall of the atomizing sleeve tube 421 adjacent to the second chamber 49 is provided with a second liquid inlet 4221. The cigarette liquid can enter the inner cavity of the atomizing sleeve 42 from the first liquid inlet 4211 and the second liquid inlet 4221. In one embodiment, the cross-sectional area of the first liquid inlet 4211 is smaller than the cross-sectional area of the second liquid inlet 4221. Specifically, the first liquid inlet 4211 and the second liquid inlet 4221 are both circular openings, the diameter of the first liquid inlet 4211 is smaller than the second liquid inlet 4221, the circular opening is convenient for design and manufacture, and improves production efficiency. The smoke flows from the first chamber will improve the temperature of the heating assembly 41 located in the second chamber 49, which may enhance the amount of cigarette consumption of the heating assembly 41 located in the second chamber 49. That is, under the same voltage, the heating assembly located in the second chamber may need more mount of cigarette liquid than the heating assembly located in the first chamber. The liquid inlet holes of different sizes are selected to meet different liquid inlet requirements, so that the first liquid inlet 4211 near the first chamber 48 is smaller than the second liquid inlet 4221 of the second chamber 49. furthermore, a third liquid inlet 4222 is defined in the sidewall of the atomizing sleeve 42, the smoke can enter the first chamber 48 and the second chamber 49 through the third liquid inlet 4222, respectively, so as to increase the entry amount of cigarette liquid in the atomizing sleeve 42 to prevent dry burning.

Figure 2:
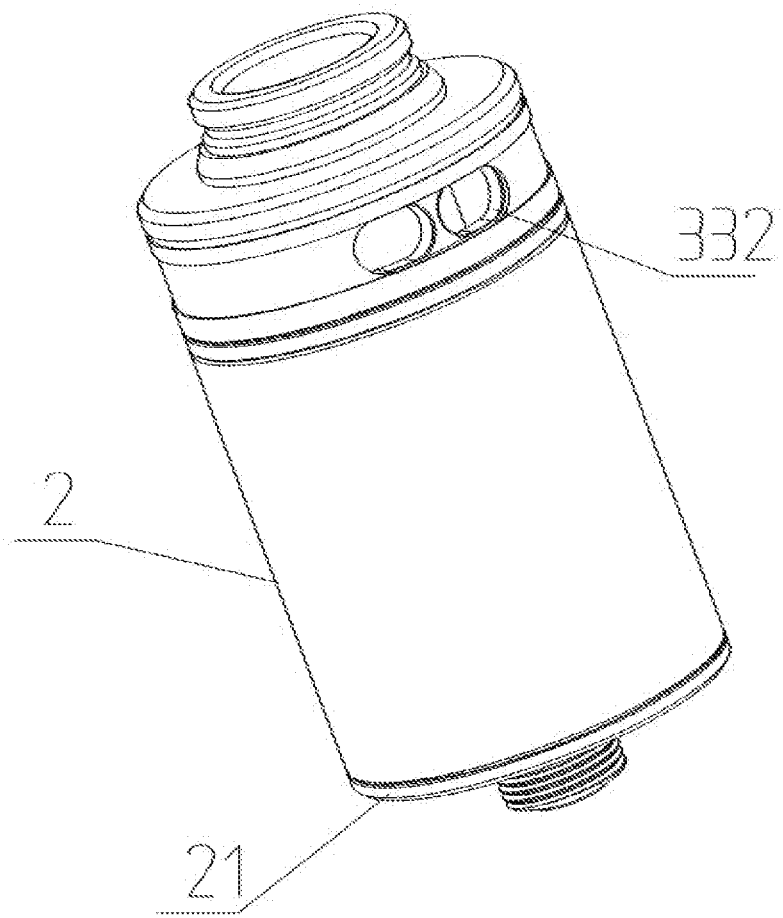
FIG. 2 is another perspective view of the atomizer of FIG. 1 when the adjustment hole is in communication with the liquid injection hole.

FIGS. 2-4, in one embodiment, the adjusting assembly 3 includes a connecting member 31, a vent pipe 32, an adjustment inner ring 33, and an adjustment outer ring 34. The bottom end of the connecting member 31 is screwed to the top of the protrusion body 4213 of the atomizing head 4. Specifically, the inner peripheral surface of the bottom end of the connecting member 31 is formed with an internal thread threaded engagement with the upper end of the atomizing sleeve 42 of the atomizing head 4, which can make the connecting member 31 stably connected to the top of the atomizing sleeve 42 of the atomizing head 4. Further, in order to improve the sealing of th36connection, a sealing gasket can be provided between two or more components. When the connecting member 31 is attached to the atomizing head 4, a reservoir chamber 36 is constituted by the outer peripheral wall of the atomizing head 4, the peripheral wall of the connecting member 31 and the inner peripheral wall of the liquid storage tube 22.

In one embodiment, the vent pipe 32 is sleeved in the connecting member 31, an air guiding space 37 is formed between the outer peripheral wall of the vent pipe 32 and the inner peripheral wall of the connecting member 31, the air guiding space 37 is in communication with the first chamber 48. The top end of the vent pipe 32 is connected to a smoking pipe of the top connector 1. The bottom end of the vent pipe 32 extends into the top end of the atomizing head 4 and abuts against the top end of the partition member 4231. The outside air can enter the first chamber 48 through the air guiding space 37, passes through the air cavity 47 to the second chamber 49 and the vent pipe 32, and through the smoking conduit of the top connector 1. The shape of the vent pipe 32 is adapted to the smoking pipe of the top connector 1 and is interference fitted to the smoking pipe of the top connector 1. In the embodiment, the vent pipe 32 is a semi-circular vent pipe 32 having a semi-circular cross section or a rectangular shape, as long as the ventilation requirements are met, the shapes listed above are not limited.

Figure 5:
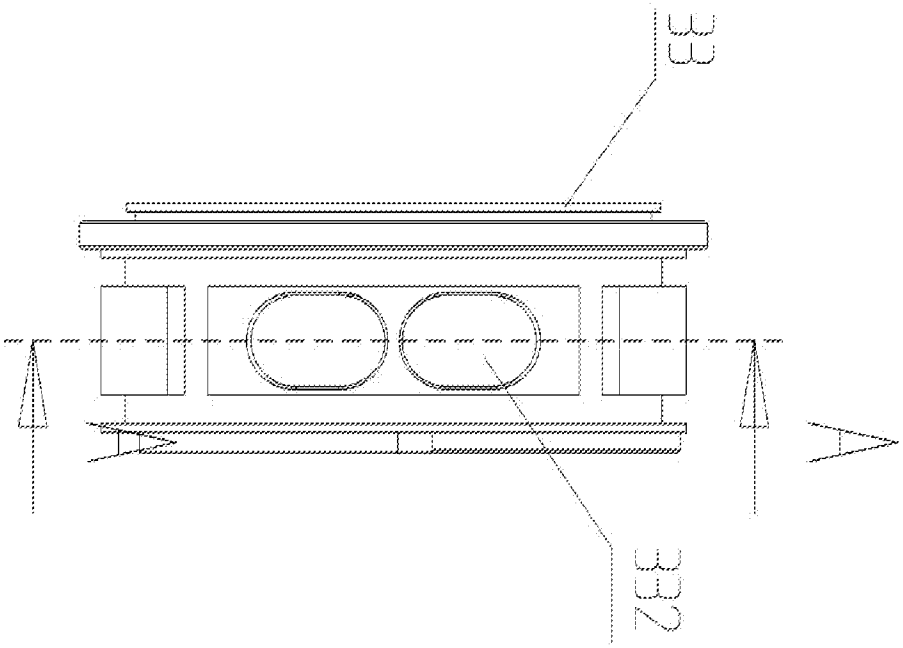
FIG. 5 is a side view of the inner ring of the atomizer of the embodiment of the present disclosure.
Figure 6:
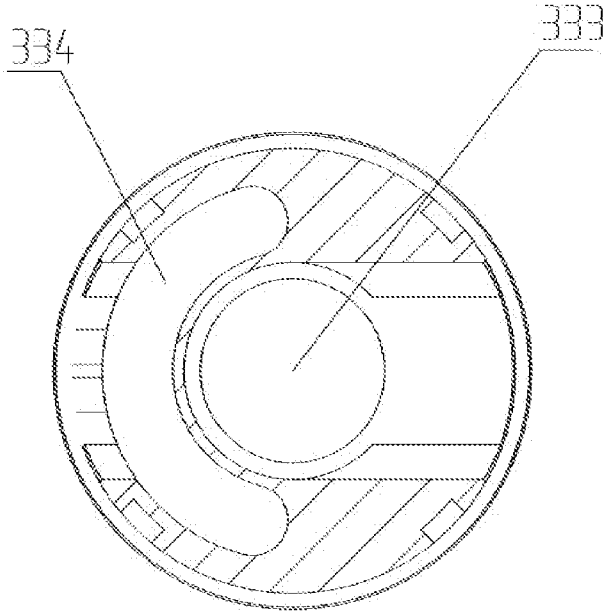
FIG. 6 is a cross-sectional view taken along the line A-A of the adjustment inner ring of FIG. 5.
Figure 7:
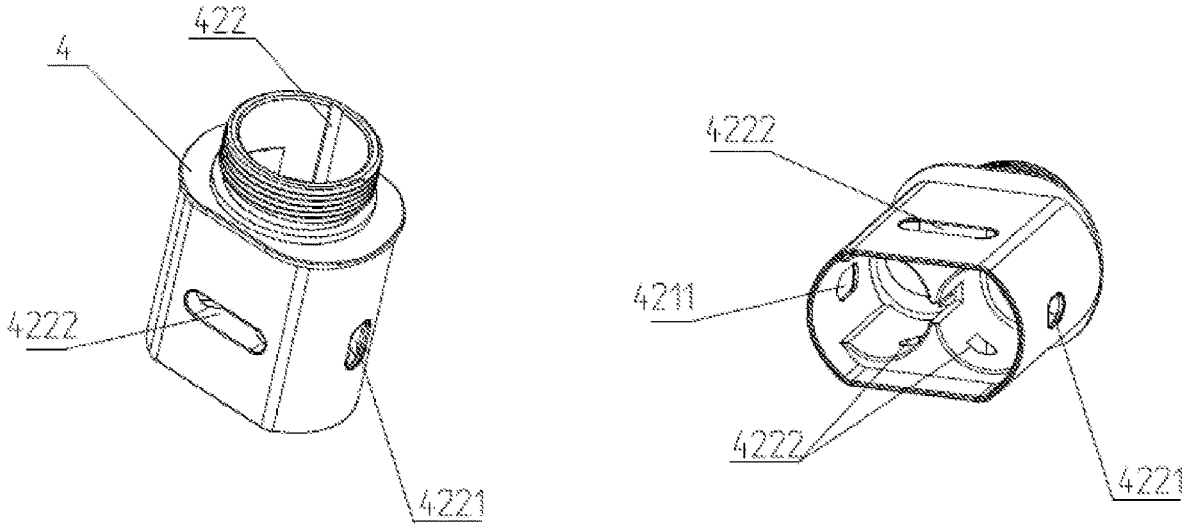
FIG. 7 is a perspective view of the atomization sleeve of the atomizer of FIG. 3.

Referring to FIG. 5 and FIG. 6, in one embodiment, the adjustment inner ring 33 has an annular shape and is provided with a mating hole extending through the opposite two ends. The adjustment inner ring 33 is mounted on the top end of the liquid storage tube 22 and is engaged with the adjustment outer ring 34 to achieve venting and liquid adjustment of the atomizer. One side of the peripheral wall of the adjustment inner ring 33 is provided with an air intake 331, and the other side of the peripheral wall is provided with an injection hole 332, the mating hole 333 penetrates the hole wall side of the air intake 331 to communicate with the air intake 331, the mating hole 333 and the air intake 331 constitute an air intake cavity. In one embodiment, the mating hole 333 is a shaft hole.

A liquid guiding hole 334 (a circular arc hole is shown in FIG. 6) corresponding to the injection hole 332 is disposed on a side of the bottom wall of the inner ring. The liquid guiding hole 334 in communication with the injection hole 332 to form a liquid injection channel. The mating hole 333 and the liquid injection passage are isolated by the wall of the mating hole 333 facing the injection hole 332.

The vent pipe 32 connected to the bottom end of the top connector 1 extends through the mating hole 333 and is received in the connecting member 31. The top end of the connecting member 31 is mounted at the lower end of the mating hole 333, the first chamber 48 is in communication with the air guiding space 37, the liquid injection passage is in communication with the reservoir chamber 36 disposed of the liquid storage assembly 2.

In one embodiment, the adjustment outer ring 34 is sleeved on the adjustment inner ring 33, the adjustment outer ring 34 includes a top wall and a peripheral wall. A center hole 341 corresponding to the mating hole 333 of the adjustment inner ring 33 is defined on the top wall of the adjustment outer ring 34 to mount the top connector 1. One side of the peripheral wall of the adjustment outer ring 34 is provided with an adjustment hole 342, the adjustment outer ring 34 is rotatably sleeved on the adjustment inner ring 33. Rotating the Adjustment outer ring 34, the adjustment hole 342 can be in communication with the air intake 331 on the peripheral wall of the adjustment inner ring 33 or the injection hole 332 on the peripheral wall of the adjustment inner ring 33. When the adjustment hole 342 is in communication with the air intake 331, the airflow passes through the air intake cavity and the air guiding space 37, to the first chamber 48, the air cavity 47 and the second chamber 49, and then to the vent pipe 32 and the smoking pipe of the top connector 1; adjusting the communication area of the adjustment hole 342 and the air intake 331 can adjust the amount of the intake air. When the adjustment hole 342 is communication with the injection hole 332, the cigarette liquid can be injected into the reservoir chamber 36.

In one embodiment, the top connector 1 is mounted on the top end of the adjustment outer ring 34, the bottom surface of the top connector 1 is provided with a guiding tube 11 for connecting the vent pipe 32. The vent pipe 32 is inserted into the guiding tube 11 and is interference fitted with the guiding tube 11. The top connector 1 defines a smoke guiding hole 12 in communication with the guiding tube 11, the smoke guiding hole 12 and the guiding tube 11 constitute form the smoking pipe. The outer peripheral surface of the top connector 1 is threaded, so that the top connector 1 is screwed to a mouthpiece (not shown), the mouthpiece is in communication with the smoking pipe.

In one embodiment, when the user hales through the mouthpiece, the smoke liquid passes through the first liquid inlet 4211, the second liquid inlet 4221 and the third liquid inlet 4222 defined on the tube wall of the atomizing sleeve 42 of the atomizing head 4, to the liquid guiding member 412. The liquid guiding member 412 guides the cigarette liquid into the heating member 411. The heating member 411 is electrically conductive and then heated to atomize the matrix. Rotating the Adjustment outer ring 34, the adjustment hole 342 can be rotated to in communication with the air intake 331, the communication area also can be adjusted. The outside air passes through the adjustment hole 342 into the first chamber 48, the air guiding space 37, and flows through the air cavity 47 to carry the smoke to the vent pipe 32, and finally, the smoke is carried into the top connector 1 and flows out of the mouthpiece. The communication area of the adjustment hole 342 and the air intake 331 is adjusted to adjust the amount of intake air. When the reservoir chamber 36 is not timely added with cigarette liquid or the liquid stored in the reservoir chamber 36 is insufficient, rotating the adjustment outer ring 34 to make the adjustment hole 342 in communication with the injection hole 332, the liquid can be injected into the reservoir chamber 36. In addition, in the atomizer of the present disclosure, the liquid guiding member 412 is made of cotton or cotton cloth, fiber cotton or porous ceramic material, the cigarette liquid stored in the reservoir chamber 36 can be guided to the heating member 411 by the liquid guiding member 412. The liquid guiding member 412 can store the amount of the liquid smoke to avoid dry burning to affect the taste of the user.

The atomizer of the present disclosure can adjust the intake air by rotating the adjustment outer ring 34 or facilitate the injection into the reservoir chamber 36, which greatly facilitates the operation of the air conditioning or the liquid injection. Further, the atomizing head 4 is easily dissembled from the connecting member 31, thus the atomizing head 4 can be integrally replaced. In order to improve the sealing property of the liquid storage tube 22, the sealing gasket 214 is disposed between the liquid storage tube 22 and the lower cover 21 during installation.

Further, the present disclosure provides an electronic cigarette having the atomizer, and further comprising a battery assembly mounted at a bottom end of the atomizer. The battery assembly is connected to the bottom end of the liquid storage assembly 2 and is electrically connected to the electrode contact assembly 23. During the operation of the electronic cigarette, the battery pack supplies power to the atomizer, the user inhales through the mouthpiece.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. An atomizing head, comprising:

an atomizing sleeve mounted on an atomizing base, wherein the atomizing sleeve comprises a first chamber and a second chamber that are separated by a separator disposed along an axial direction of the atomizing sleeve and wherein the separator forms a partition between the first chamber and the second chamber; and a first heating assembly disposed in the first chamber and a second heating assembly disposed in the second chamber, during operation, an airflow successively flows through the first chamber and the second chamber, and carries away smoke inside the atomizer head;

wherein an outlet of the first chamber and an inlet of the second chamber are in fluid communication with each other; or/and the first chamber and the second chamber are in communication with each other through an air passage formed in a sidewall disposed between the first chamber and the second chamber.

2. The atomizing head of claim 1, wherein the first chamber and the second chamber are cylindrical in shape and are disposed parallel to the axial direction of the atomizing sleeve.

3. The atomizing head of claim 1, wherein the first heating assembly and the second heating assembly each comprises a heating element and a liquid guiding member, wherein the heating element is a hollow structure having two open ends, the heating element is surrounded by the liquid guiding member, and, wherein, during operation, the heating element heats a liquid in the liquid guiding member to form an aerosol.

4. The atomizing head of claim 1, wherein the atomizing sleeve is a hollow structure having two open ends, the atomizing sleeve comprises an atomizing sleeve tube, a fixing groove defined in an inner wall of the atomizing sleeve tube, and the separator, wherein the separator is disposed in the fixing groove.

5. The atomizing head of claim 4, further comprising a first liquid inlet and a second liquid inlet disposed on the atomizing sleeve tube, wherein the first liquid inlet opens into the first chamber and the second liquid inlet opens into the second chamber.

6. The atomizing head of claim 5, wherein a cross-sectional area of the first liquid inlet is smaller than a cross-sectional area of the second liquid inlet.

7. The atomizing head of claim 1, wherein the atomizing base comprises an end plate and a tubular body mounted on the end plate, wherein the atomizing sleeve sleeves over the tubular body and forms an air cavity between a bottom end of the atomizing sleeve and the end plate of the atomizing base.

8. The atomizing head of claim 1, wherein the atomizing head further comprises an atomizing head electrode contact and an atomizing head insulating ring, the atomizing head insulating ring is sleeved on the atomizing head electrode contact, and the atomizing head electrode contact is received in the atomizing base.

9. An atomizer, comprising:

the atomizing head of claim 1; and a liquid storage assembly for storing an aerosol forming substrate;

wherein the atomizing head resides in a cavity formed in the liquid storage assembly.

10. The atomizer of claim 9, wherein the atomizer further comprises an adjusting assembly, the adjusting assembly comprises an adjustment inner ring, and an adjustment outer ring, the adjustment inner ring is located at the top end of the liquid storage assembly, the adjustment outer ring is rotatably sleeved on the adjustment inner ring; a first side of a peripheral wall of the adjustment inner ring is provided with an air intake, a second side of the peripheral wall of the adjustment inner ring is provided with an adjustment hole, wherein an amount of air entering the atomizer is adjustable by adjusting an overlapping area between the adjustment hole and the air intake.

11. The atomizer of claim 9, wherein the atomizer further comprises an adjusting assembly, the adjusting assembly comprises an adjustment inner ring, and an adjustment outer ring, the adjustment inner ring is located at the top end of the liquid storage assembly, the adjustment outer ring is rotatably sleeved on the adjustment inner ring; a first side of the peripheral wall of the adjustment inner ring is provided with an injection hole, a second side of the peripheral wall is provided with an adjustment hole, when the adjustment hole is in fluidly communication with the injection hole so as to receive the aerosol forming substrate injected into the liquid storage assembly.

12. The atomizer of claim 10, wherein the adjusting assembly comprises a connecting member and a vent pipe, the connecting member is received in the liquid storage assembly, the vent pipe is disposed in the connecting member, an air guiding space is formed between an outer peripheral wall of the vent pipe and an inner peripheral wall of the connecting member, the air guiding space is in communication with the first chamber.

13. The atomizer of claim 11, wherein the adjusting assembly comprises a connecting member and a vent pipe disposed in the connecting member, wherein the connecting member is received in the liquid storage assembly, an air guiding space is formed between an outer peripheral wall of the vent pipe and an inner peripheral wall of the connecting member, and the air guiding space is in fluid communication with the first chamber.

14. The atomizer of claim 9, wherein the first chamber and the second chamber are cylindrical in shape and are parallel to the axial direction of the atomizing sleeve.

15. An electrical cigarette, comprising:

an atomizer comprising a liquid storage assembly for storing an aerosol forming substrate and the atomizing head of claim 1 received in the liquid storage assembly, and a battery assembly electrically connected to the atomizer.

16. The electrical cigarette of claim 15, wherein the atomizer further comprises an adjusting assembly, the adjusting assembly comprises an adjustment inner ring, and an adjustment outer ring, the adjustment inner ring is located at the top end of the liquid storage assembly, the adjustment outer ring is rotatably sleeved on the adjustment inner ring; a first side of a peripheral wall of the adjustment inner ring is provided with an air intake, a second side of the peripheral wall of the adjustment inner ring is provided with an adjustment hole, wherein an amount of air entering the atomizer is adjustable by adjusting a overlapping area between the adjustment hole and the air intake.

17. The electrical cigarette of claim 15, wherein the atomizer further comprises an adjusting assembly, the adjusting assembly comprises an adjustment inner ring, and an adjustment outer ring, the adjustment inner ring is located at the top end of the liquid storage assembly, the adjustment outer ring is rotatably sleeved on the adjustment inner ring; a first side of the peripheral wall of the adjustment inner ring is provided with an injection hole, a second side of the peripheral wall is provided with an adjustment hole, when the adjustment hole is in fluidly communication with the injection hole so as to receive the aerosol forming substrate injected into the liquid storage assembly.

18. The electrical cigarette of claim 15, wherein the adjusting assembly comprises a connecting member and a vent pipe disposed in the connecting member, wherein the connecting member is received in the liquid storage assembly, an air guiding space is formed between an outer peripheral wall of the vent pipe and an inner peripheral wall of the connecting member, and the air guiding space is in fluid communication with the first chamber.

* * * * *